United States Patent [19]

Hanada et al.

[11] Patent Number: 4,578,660

[45] Date of Patent: Mar. 25, 1986

[54] HOUSING FOR AN ELECTROMAGNETIC RELAY

[75] Inventors: Koji Hanada; Yuji Kinoshita; Masaru Tamura, all of Suzaka, Japan

[73] Assignee: Fujitsu Limited, Kawasaki, Japan

[21] Appl. No.: 375,030

[22] PCT Filed: Sep. 1, 1981

[86] PCT No.: PCT/JP81/00210

§ 371 Date: Apr. 21, 1982

§ 102(e) Date: Apr. 21, 1982

[87] PCT Pub. No.: WO82/00918

PCT Pub. Date: Mar. 18, 1982

[30] Foreign Application Priority Data

| | | | |
|---|---|---|---|
| Sep. 1, 1980 | [JP] | Japan | 55-124078 |
| Sep. 26, 1980 | [JP] | Japan | 55-136839 |
| Oct. 29, 1980 | [JP] | Japan | 55-154365 |
| Feb. 25, 1981 | [JP] | Japan | 56-26536 |

[51] Int. Cl.[4] ..... H01H 63/02

[52] U.S. Cl. ..... 335/133; 335/162; 335/202

[58] Field of Search ..... 335/106, 107, 125, 128, 335/133, 162, 185, 202

[56] References Cited

U.S. PATENT DOCUMENTS

| | | | |
|---|---|---|---|
| 3,474,367 | 10/1969 | Zupa | 335/274 |
| 4,321,569 | 3/1982 | Bernier | 335/202 X |
| 4,346,359 | 8/1982 | Pirner et al. | 335/202 |
| 4,398,165 | 8/1983 | Iketani | 335/133 |

FOREIGN PATENT DOCUMENTS

| | | | |
|---|---|---|---|
| 54-37854 | 3/1979 | Japan | 335/133 |

OTHER PUBLICATIONS

English Translation of Japanese Patent No. 54-37854

*Primary Examiner*—George Harris
*Attorney, Agent, or Firm*—Staas & Halsey

[57] ABSTRACT

A small electromagnetic relay in which an electromagnet (116), having at least a core (130), a coil bobbin (128) and an armature (117), is accommodated in a box-shaped insulated housing (110) which has surrounding walls (114*a*, 114*b*) to hold contact terminals (111*a*, 111*b*, 112*a*, 112*b*), the electromagnet having an accommodation portion that is molded on the outer surface of a flange (138) of the coil bobbin as a unitary structure to rotatably hold the armature, the coil bobbin being equipped with the armature and the core.

19 Claims, 24 Drawing Figures

130
128
129
116
117
118
131
131a
132
120
117'
135
136a
136b
134
133
137a
137b
118a
118b
119a
119b
138
138a
138b
139a
139a'
139b
139b'

HOUSING FOR AN ELECTROMAGNETIC RELAY

DESCRIPTION

BACKGROUND OF THE INVENTION

The present invention relates to a thin, small relay which is mounted chiefly on printed boards. Especially, the invention relates to an electromagnetic relay of the construction in which an electromagnet, having at least a core, a coil and an armature, is accommodated in a box-like insulated housing which has surrounding walls to hold terminals of fixed and moving contacts, and to a method of manufacturing the same.

FIG. 1 is a perspective view of a conventional small electromagnetic relay (hereinafter simply referred to as a relay), and FIG. 2 is a perspective view illustrating the relay of FIG. 1 in a disassembled manner. In these drawings, reference numeral 10 denotes a support member composed of an insulating material which forms a rectangular box with its upper side being open and the bottom being closed. The opposing side walls 11 of the support member 10 have through holes 12 in which terminals will be inserted. The side walls 11, further, have projections 13 for fastening a moving contact spring member on the upper surfaces thereof, and projections 15 for securing a yoke plate in the recessed portions 14. A side wall 16 has a slit or slot 17.

Reference numerals 20, 20', 21, and 21' denote fixed contact terminals, 22 and 22' denote coil terminals, and 23, 23' denote terminals for lead contacts. These terminals have at their lower ends escape-preventing pieces 24 that fold after the terminals are inserted in the through holes 12 of the side walls 11. The fixed contact terminals 20(21) and 20'(21') have a difference in height at the contact points 25. Moving contact springs, which will be mentioned later, are disposed between the contacts 25 to form transfer contacts.

Reference numeral 30 denotes an electromagnet consisting of a core 32 on which a coil 31 is wound, an L-shaped yoke plate 33, and an L-shaped armature 34. Lead wires of the coil 31 are wound on connection portions 26 of coil terminals 22, 22' and are soldered. The core 32 is fastened by caulking at one end to the yoke plate 33; the other end of the core 32 works as an attracting portion 35 to attract the armature 34. The yoke plate 33 has projections 37 with holes 36 on both sides thereof, and the armature 34 has a drive piece 38 for engaging a moving contact spring member and a projection 39 in the narrow portion thereof. Reference numeral 40 denotes a moving contact spring member having a pair of moving contact springs 41 with one end of each spring 41 being fastened to a molded member 42.

Each of the moving contact springs 41 is slightly bent. One end of each contact spring 41 has contacts 43, 43' on the front and back surfaces to come into contact with the fixed contacts 20(21) and 20'(21'), and the other end has a connection piece 45 that is directly soldered to connection portion 27 of the terminal 23 or 23' for the lead contact. A molded insulator 44 is provided at the central portion of each contact spring 41. The molded member 42 has, on both sides, holes 46 into which the projections 13 are inserted. Reference numeral 50 denotes a release leaf spring which also works to prevent the armature 34 from escaping, and which consists of an L-shaped spring piece 52 having a hole 51 in one end thereof, and insertion pieces 54 with rising portion 53, which are formed as a unitary structure. Reference numeral 60 denotes a transparent relay cover.

How the above-mentioned relay is assembled is described below. In the relay, the individual members are all mounted through the openings of the support member 10. That is, fixed contact terminals 20, 20', 21, 21', coil terminals 22 and 22', and contact lead terminals 23, 23' are inserted in the through holes 12 of the support member 10, and are secured by escape-preventing pieces 24. The electromagnet 30 is disposed in the housing with the core 32 on the lower side and the yoke plate 33 on the side of the opening, whereby projections 37 and holes 36 are fitted into the recessed portions 14 and projections 15. The armature 34 is inserted between one end a of the yoke plate 33 and the side wall 16, with the drive piece 38 disposed on the yoke plate 33, such that one end a is brought into agreement with the folded portion b of the armature 34. Under this condition, the armature 34 faces the attracting portion 35, and the folded portion b is folded at an angle that is slightly greater than 90°, so that a gap is formed relative to the attracting portion 35.

The release leaf spring 50 is inserted in the slit 17 and is allowed to stay therein utilizing the resilient force of the rising portion 53. The spring piece 52 of the release leaf spring 50 is positioned on the armature 34, so that the projection 39 is fitted into the hole 51.

In the moving contact spring assembly 40, projections 13 are fitted into the holes 46 to place the molded member 42 on the side walls 11, with the moving contact springs 41 of the moving contact spring assembly 40 being interposed between the fixed contact 20(21) and the fixed contact 20'(21'), and with the insulator 44 being placed on the drive piece 38. Thereafter, projections 13, 15 protruding through holes 36, 46 are heated and caulked so that yoke plate 33 and the moving contact spring assembly 40 become attached to the side walls 11 of the support member 10. At the same time, the lead wires of the coil 31 are wound and soldered onto the connection portions 26, and the connection portions 27 are soldered to the connection pieces 45. Finally, the relay cover 60 is mounted on the support member 10 to produce the relay.

In the above-mentioned relay, the moving contact springs 41 are electrically connected to the fixed contact terminal 20'(21') when the electromagnet is not being excited. When the electromagnet 30 is excited, the armature 34 is attracted to the attracting portion 35, whereby the drive piece 38 pushes the moving contact springs 41 up via the insulator 44; the moving contact springs 41 come into contact with the fixed contact terminals 20(21) to switch the contact.

In the above-mentioned conventional relay, however, the following inconveniences occur, since electromagnet 30, moving contact spring member 40, release leaf spring 50, and contact spring terminals 20, 20', 21, 21' are successively mounted into the box-shaped housing 10 which is formed by molding and which is composed of an insulating resin.

(1) A lot of assembling steps are necessary to manufacture a relay, requiring extended periods of time and a long assembly line.

(2) The assembling operation becomes cumbersome as the assembling operation proceeds. Therefore, parts tend to be deformed, and it becomes difficult to produce relays with a high degree of reliability.

(3) So many parts are assembled in the housing that the above-mentioned defects (1) and (2) become conspicuous, particularly when relays of a small size are constructed. Accordingly, reducing the size of the relay cannot be achieved.

SUMMARY OF THE INVENTION

In order to solve the aforementioned problems inherent in the conventional relays, the present invention deals with a relay in which an electromagnet is accommodated in a box-shaped housing which has surrounding walls to hold contact spring terminals, wherein a portion for accommodating an armature is integrally formed on the outer surface of the flange of the coil bobbin that is employed for the electromagnet, and the contact spring terminals are attached to the surrounding walls of the box-shaped housing by insertion-molding. Owing to this idea, the object of the present invention is to provide a relay which can be assembled efficiently and easily, within a short period of time and using a reduced number of parts, which can therefore be economically produced, and which has a reduced thickness and is small in size, and to provide a method of manufacturing the same.

The present invention is concerned with an electromagnetic relay in which an electromagnet, having at least a core, a coil bobbin on which the coil is wound and an armature, is accommodated in a box-shaped insulated housing which has surrounding walls to hold fixed contact terminals and moving contact spring terminals, wherein the outer surface the coil bobbin is equipped with a flange having a portion which is molded as a unitary structure together with the coil bobbin and which rotatably holds the armature, and wherein the armature and the core are mounted on the coil bobbin.

DESCRIPTION OF THE PREFERRED EMBODIMENTS

Figure 1:
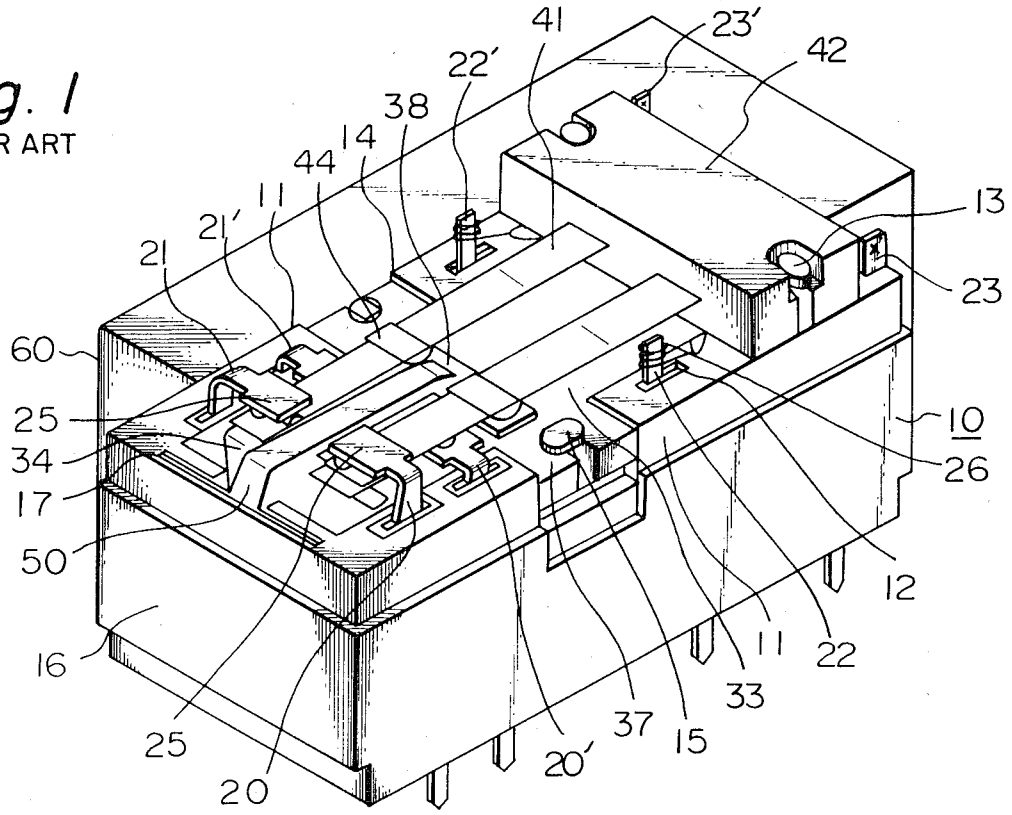
Fig. 1 PRIOR ART
FIG. 1 is a perspective view of a conventional relay.
Figure 2:
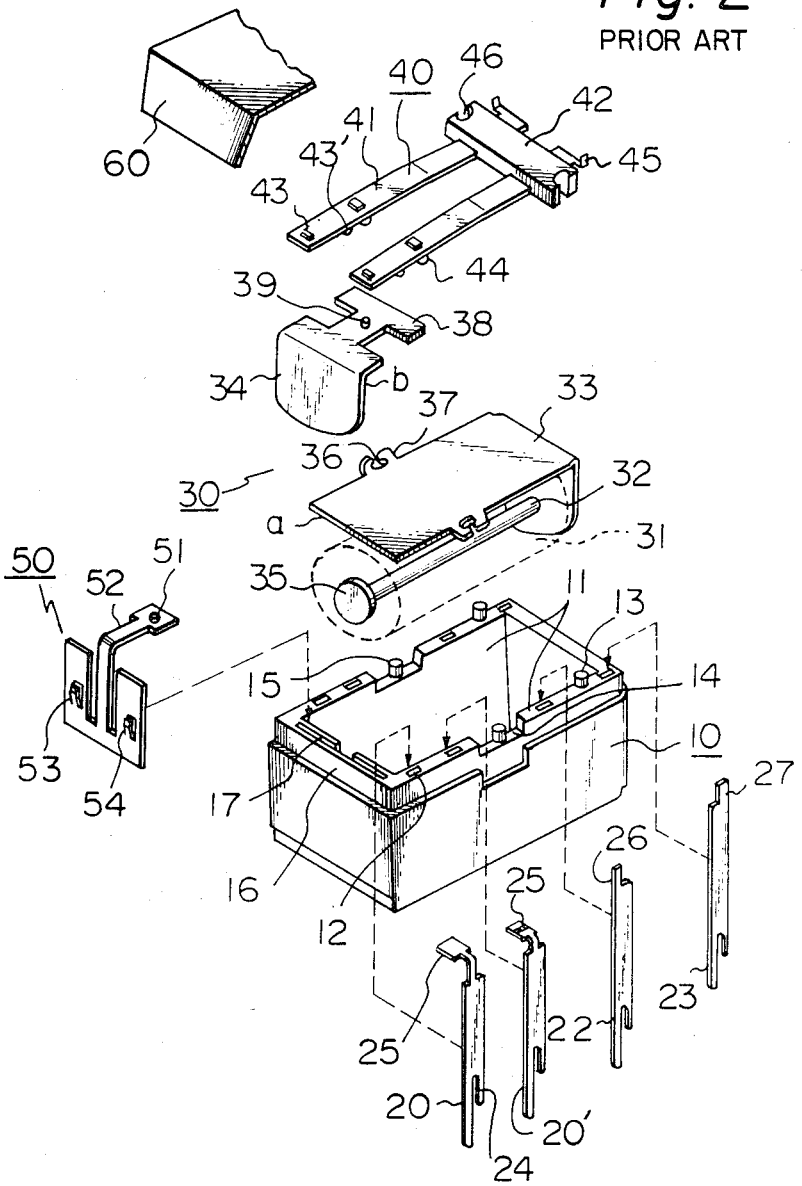
Fig. 2 PRIOR ART
FIG. 2 is an exploded perspective view showing the relay of FIG. 1.
Figure 3:
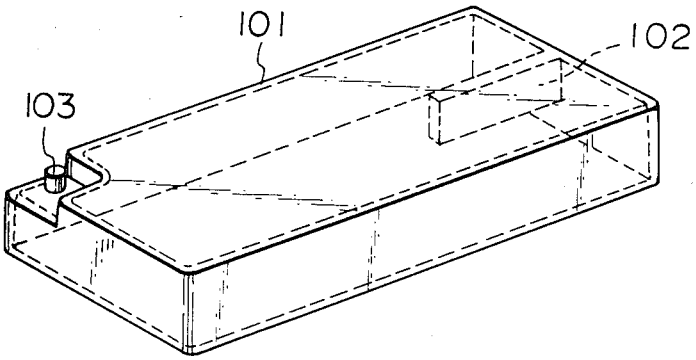
FIG. 3 is a perspective view showing a relay according to an embodiment of the present invention.
Figure 3:
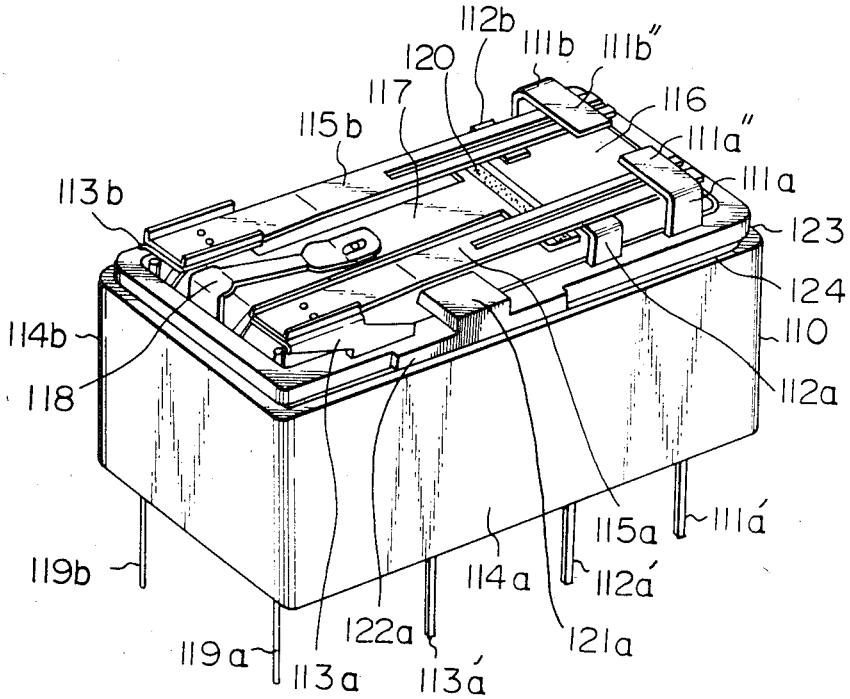
Figure 4:
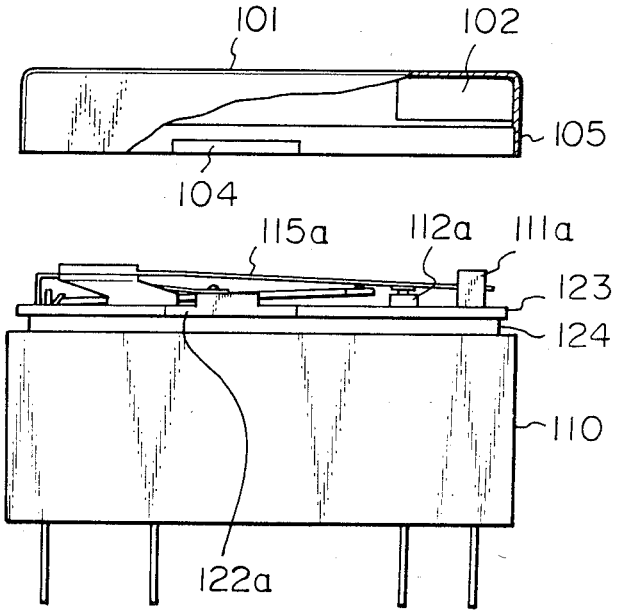
FIG. 4 is a side view showing, partly in cross section, of the relay of FIG. 3.

An embodiment of the present invention will be described below in conjunction with the drawings. FIGS. 3 and 4 are a perspective view and a side view, respectively, illustrating the state in which a relay cover 101 is removed from the relay of the embodiment of the present invention. In FIG. 3, reference numeral 110 denotes a box-like housing which is formed by molding an insulating material, such as synthetic resin, and which is open in both the upper and lower surfaces; 111*a* and 111*b* denote fixed contact terminals on the "making" side; 112*a* and 112*b* denote fixed contact terminals on the "breaking" side; and 113*a* and 113*b* denote terminals for mounting moving contacts. These fixed contact terminals 111*a*, 111*b*, 112*a*, 112*b*, and moving contact-mounting terminals 113*a*, 113*b*, are insertion-molded in opposing side walls 114*a* and 114*b* of the housing 110. The fixed contact terminals 111*a*, 111*b*, 112*a*, 112*b*, and moving contact-mounting terminals 113*a*, 113*b* have terminal portions 111*a*', 111*b*', 112*a*', 112*b*', 113*a*', and 113*b*' for connection to external circuits. FIG. 3, however, does not show terminal portions 111*b*', 112*b*', 113*b*'. Contact portion 111*a*" (or 111*b*") of the fixed contact terminal 111*a* (or 111*b*) and contact portion 112*a*" (or 112*b*") of the fixed contact terminal 112*a* (or 112*b*) have a difference in height, and a moving contact spring 115*a* (or 115*b*) is disposed between the contact portion 111*a*" (or 111*b*") and the contact portion 112*a*" (or 112*b*") to form a transfer contact. The rear ends of the moving contact springs 115*a* and 115*b* are welded to the terminals 113*a* and 113*b* for mounting the moving contacts. Further, the moving contact springs 115*a* and 115*b* are urged toward the fixed contact terminals 112*a* and 112*b* on the breaking side. When the electromagnet 116 is not energized, therefore, the moving contacts 115*a* and 115*b* are electrically contacted to the fixed contact terminals 112*a* and 112*b* on the breaking side.

The housing 110 contains the electromagnet 116. FIG. 3 shows an armature 117 of the electromagnet 116, an armature-holding spring 118, coil terminals 119*a*, 119*b*, and an insulator 120 attached to an end of the armature 117 that pushes up the moving contact springs 115*a*, 115*b*. Protrusions 121*a*, 121*b* are formed on the central upper portions of the opposing side walls 114*a*, 114*b* of the housing 110 to hold in position the electromagnet that is inserted through the lower opening of the housing 110. Protrusions 122*a*, 122*b* are further formed in the vicinity of the protrusions 121*a*, 121*b*, so as to be fitted to the recessed portions (not shown) of a relay cover 101, such that the relay cover is firmly fastened to the housing 110. FIG. 3 does not illustrate protrusions 121*b*, 122*b*.

The relay cover 101 is formed by molding an insulating material, such as a transparent synthetic resin. A separator wall 102 for separating the contacts is formed on the inner side of the relay cover 101 so that it is disposed between the side having fixed contact terminals 111*a*, 112*a* and the side having fixed contact terminals 111*b*, 112*b*, thereby increasing the voltage isolation among the terminals. A protrusion 103 is formed at a corner of the relay cover 101. The protrusion 103 will be cut off after the relay is assembled, mounted on a printed board by the dipping of solder, and washed to remove solder flux; i.e., a ventilation port is formed in the relay cover 101 to radiate the heat.

As shown in FIG. 4, furthermore, a stepped portion 123 is formed at the upper end of the side walls of the housing 110 to engage with a thin wall 105 formed at the lower peripheral portion of the relay cover 101. The stepped portion 123 has a groove 124 which is filled with an adhesive to join the housing 110 and the relay cover 101. The groove 124 further engages with projections 104 provided at the lower peripheral edge of the relay cover 101.

Figure 5:
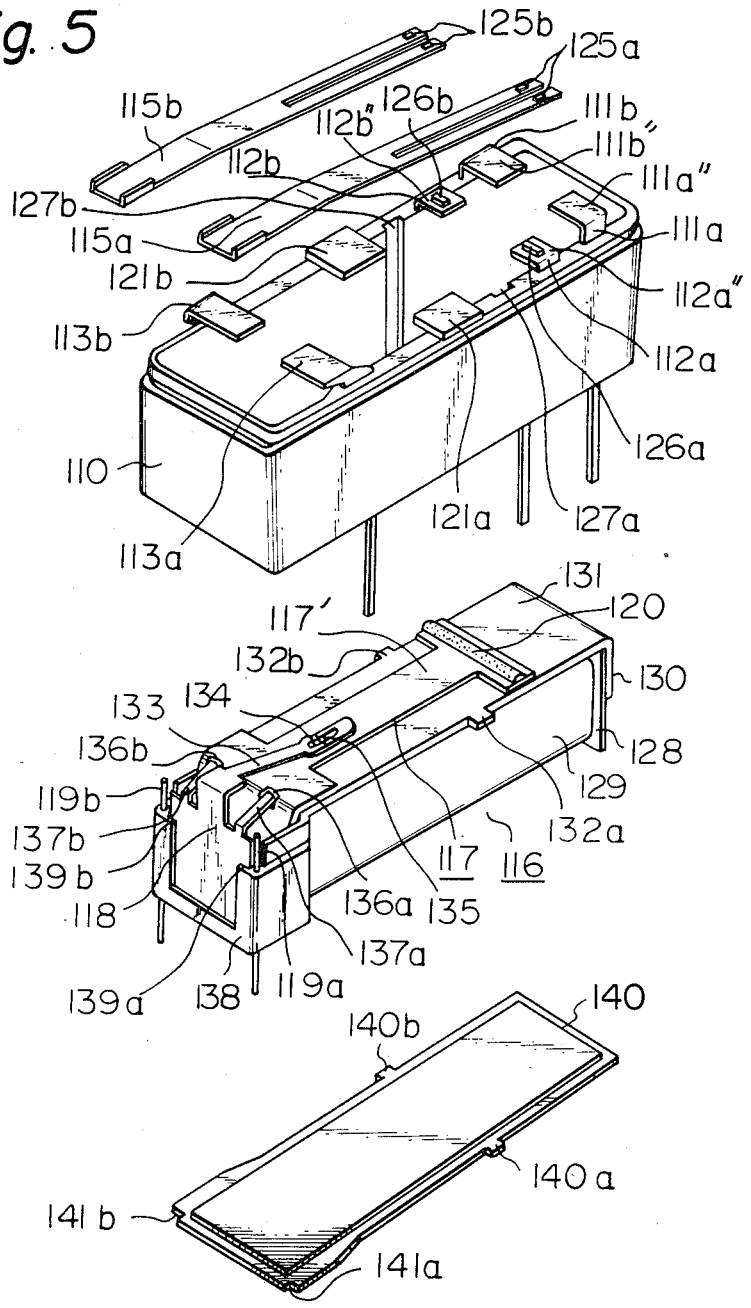
FIG. 5 is an exploded perspective view showing parts which constitute the relay of FIG. 3.

FIG. 5 is a perspective view showing the parts, which constitute the relay, in a disassembled manner. That is, the relay consists of a housing assembly, into which the contact springs are insertion-molded, the electromagnet 116, which is inserted through the lower opening of the housing assembly, a back cover or bottom plate 140 and the relay cover 101, which is not shown here.

In the housing assembly, fixed contact terminals 111*a*, 111*b*, 112*a*, 112*b*, and moving contact-mounting terminals 113*a*, 113*b* are insertion-molded into the insulating material of the housing 110, as mentioned above. Moving contact springs 115*a*, 115*b* having the shape of a fork are spot-welded onto the moving contact-mounting terminals 113*a*, 113*b*. Contacts members 126*a*, 126*b* are attached to the upper surface of contact portions 112*a*'', 112*b*'' of the fixed contact terminals 112*a*, 112*b*, and contact members, which are not shown, are also attached to the lower surfaces of contact portions 111*a*'', 111*b*'' of the fixed contact terminals 111*a*, 111*b*. Contact members 125*a*, 125*b* are welded onto the upper surfaces of the forked portions of the moving contact springs 115*a*, 115*b* at positions opposed to the contact members of the fixed contact terminals 111*a*, 111*b*, and contact members, which are not shown, are also welded onto the lower surfaces of the forked portions at positions opposed to the contact members 126*a*, 126*b* of the fixed contact terminals 112*a*, 112*b*.

Figure 17:
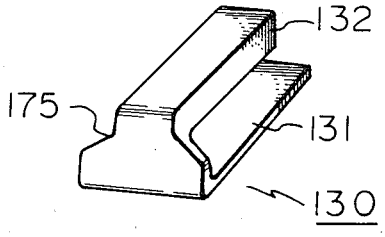
FIG. 17 is a perspective view of a core formed by using the magnetic member of FIG. 16.

The electromagnet 116 (illustrated disassembled in FIG. 15A) comprises a coil bobbin 128, a coil 129 wound on the coil bobbin, a core 130, a nearly L-shaped armature 117, and an armature-holding spring 118. The core 130 has a yoke 131 and a core portion 132, which is not shown in FIG. 5, but which is inserted in the coil bobbin 128; the core 130 assumes a U-shape (as illustrated in FIG. 17) and is produced by a method that will be mentioned later. Projections 132*a*, 132*b* are formed on both sides of the yoke 131. When the electromagnet 116 is inserted in the housing 110, the projections 132*a*, 132*b* are fitted into the guide grooves 127*a*, 127*b* formed in the opposing walls of the housing 110; i.e., the electromagnet 116 is placed in position in the housing. The insulator 120 is mounted on the tip portion of an arm 117' of the L-shaped armature 117, the tip portion being nearly parallel with the yoke 131 and being oriented in a direction at right angles with the axis of the arm, thereby maintaining electrical insulation between the armature 117 and the moving contact springs 115*a*, 115*b*. Further, a projection 135 is formed on the upper surface of the arm to engage with an opening 134 formed in a tip portion of the spring piece 133 of the armature-holding spring 118. Recessed portions 136*a*, 136*b* are formed in the outer side at the folded portion of the armature 117. Tongue pieces 137*a*, 137*b* of the armature-holding spring 118 are engaged with the recessed portions 136*a*, 136*b*. The armature-holding spring 118 is inserted in grooves 139*a*, 139*b* formed in a flange 138 of the coil bobbin 128. Coil terminals 119*a*, 119*b* are insertion-molded into the flange 138, and lead wires from the coil 129 are soldered to the upper ends of the coil terminals 119*a*, 119*b*.

The back cover 140 has projections 140*a*, 140*b* that fit guide grooves 127*a*, 127*b* of the housing 110, and notched portions 141*a*, 141*b* through which coil terminals 119*a*, 119*b* of the electromagnet 116 are allowed to pass.

To manufacture the relay using the above-mentioned parts, the electromagnet 116 is inserted through the lower opening of the housing assembly, and the back cover 128 and the relay cover 101 are adhesively attached to the housing 110. Next, the whole relay is washed with a washing solution, and the protrusion 103 is cut off from the relay cover 101 to form a ventilation port for releasing the heat. The relay is thus assembled.

Below is mentioned the operation of the relay. When the electromagnet 116 is not excited, the arm 117' of armature 117 is pressed toward the yoke of the core 130 by the spring piece 133 of the armature-holding spring 118, as will be obvious from FIGS. 3 through 5. Therefore, the moving contact springs 115*a*, 115*b* contact the fixed contact terminals 112*a*, 112*b* on the breaking side due to their own resiliency. When the electromagnet 116 is excited, another arm of the armature 117 is attracted by the core 132, whereby the arm 117' is pushed up against the force of spring piece 133 of the armature-holding spring 118. Consequently, the moving contact springs 115*a*, 115*b* are pushed up via the insulator 120, and come into electric contact with the fixed contacts 111*a*, 111*b* on the making side, to switch the contacts.

Figure 6:
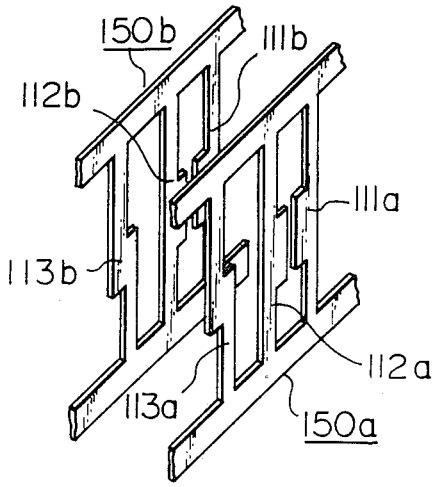
FIG. 6 is a perspective view showing lead frames used for the relay of FIG. 3.
Figure 7:
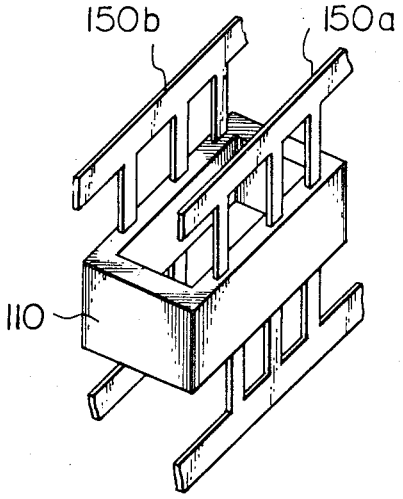
FIG. 7 is a perspective view showing an insertion-molded base which includes the lead frames of FIG. 6.

Below is mentioned the method of producing parts which constitute the relay. The housing assembly is obtained by insertion-molding contact terminals into the housing 110, which comprises an elongated frame, as mentioned above. That is, two lead frames 150*a*, 150*b*, obtained from a hoop member of phosphor bronze by press working, are positioned opposite each other and separated by a predetermined distance, as shown in FIG. 6. The lead frame 150*a* has fixed contact terminals 111*a*, 112*a* and moving contact-mounting terminal 113*a*, and the lead frame 150*b* has fixed contact terminals 111*b*, 112*b* and moving contact-mounting terminal 113*b*. Then, as shown in FIG. 7, the housing 110 is so molded as to contain the opposing terminals in the side walls; thus, the insertion-molded base is prepared.

Figure 8:
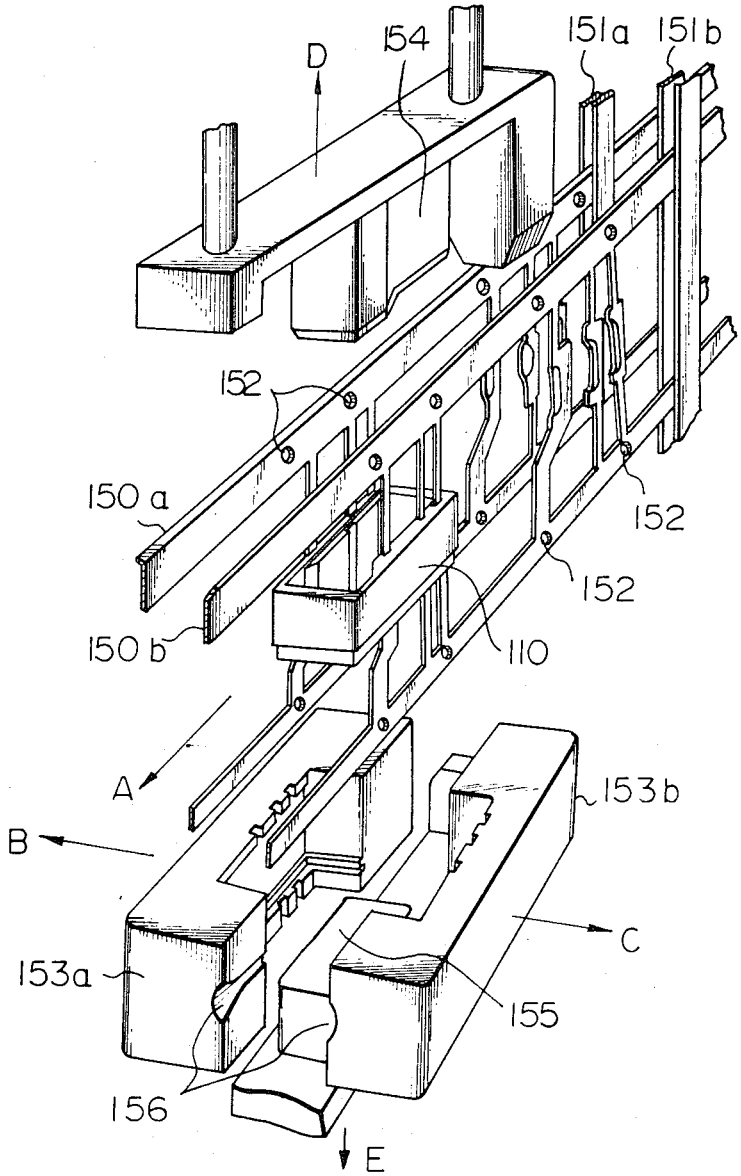
FIG. 8 is a perspective view schematically illustrating the facility for producing the insertion-molded base of FIG. 7.

FIG. 8 schematically illustrates the facility for insertion-molding the above-mentioned housing assembly, in which the two lead frames 150*a*, 150*b* are held by guide plates 151*a*, 151*b* positioned a predetermined distance apart, and are moved in the direction of arrow A after each predetermined period of time by utilizing holes 152 formed in the upper and lower strap portions of the lead frames. In FIG. 8, the lead frames 150*a*, 150*b* are reversely disposed relative to those of FIG. 6 with regard to the upper and lower directions, and right and left directions. In FIG. 8, therefore, the housing assemblies are formed upside down. The lead frames 150*a*, 150*b*, positioned a predetermined distance apart, are sandwiched by outer shells 153*a*, 153*b*, and a core 154 is inserted into the space between the lead frame 150*a* and the lead frame 150*b* from the upper direction, and a plate 155 for receiving the core 154 is placed in the lower portion. A resin is then injected through a gate portion 156 defined by the outer shells 153*a*, 153*b*. After the injected resin is solidified, the outer shells 153*a*, 153*b*, core 154 and plate 155 are moved in the directions of arrows B, C, D and E, respectively. The lead frames 150*a*, 150*b* are then moved by a predetermined distance in the direction of arrow A, and the next molding operation is executed. Thus, the insertion-molded base shown in FIG. 7 is produced continuously and automatically.

The housing assembly is completed by removing the upper and lower strap portions from the lead frames 150*a*, 150*b*, folding at right angles the upper portions of the fixed contact terminals 111*a*, 112*a*, 111*b*, 112*b* and the moving contact-mounting terminals 113*a*, 113*b*, welding the contact members to the fixed contact terminals, and spot-welding the moving contact springs 115*a*, 115*b* to the moving contact-mounting terminals 113*a*, 113*b*. It was mentioned that the contact members are welded after the upper portions of the fixed contact terminals were folded at right angles. It is, however, possible to weld the contact members prior to folding the upper portions of the fixed contact terminals at right angles.

Figure 9:
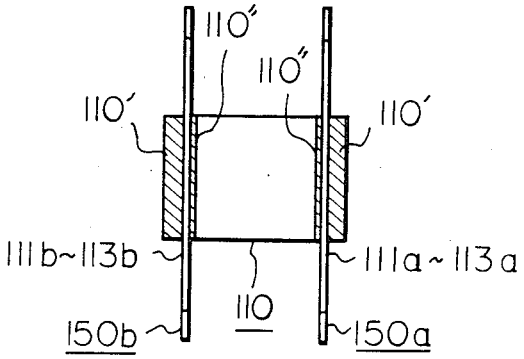
FIG. 9 is a sectional view of the insertion-molded base in which contact lead terminals are properly inserted.
Figure 10:
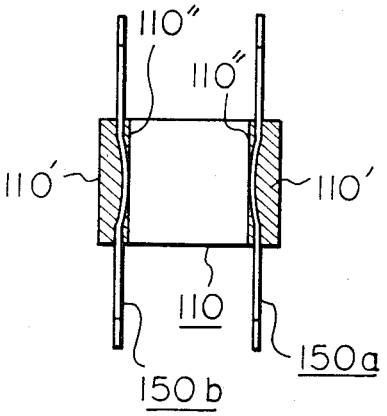
FIG. 10 is a sectional view of the insertion-molded base in which the contact lead terminals are inserted in a bent manner.

Here, it is desired to reduce the thickness of the housing 110 as much as possible, to reduce the size of the electromagnet, and to minimize the space required for mounting it. The arrangement of the contact terminals 111*a*, 112*a*, 113*a* and the like penetrating through the housing 110, however, is limited by the construction of the electromagnet 116 and by the standardized distance between the holes for mounting the relay. Therefore, the contact terminals are not often positioned in the center of the side walls of the housing 110. When the housing 110 is formed by molding, therefore, the contact terminals 111*a*, 112*a*, 113*a*, etc., which must be straight, as shown in FIG. 9, are often pushed by the resinous material that flows into the thick side 110' of the housing 110, and are bent toward the thin side 110'' of the housing 110 as shown in FIG. 10. Consequently, central portions of the contact terminals 111*a*, 112*a*, 113*a*, etc. are exposed to the inner side of the housing 110, and are often undesirably brought into contact with the electromagnet 116 that is inserted in the housing 110. To cope with this problem, the housing 110 may be formed while holding the central portions of the inserted parts (contact terminals 111*a*, 112*a*, 113*a*, 111*b*, 112*b*, 113*b*) by pins. With this method, however, holes are formed in the molded housing where the pins are inserted. Accordingly, the inserted parts are exposed, causing deterioration of the quality of the product, or an additional operation is required to fill the holes. When small products are to be molded, furthermore, pins are not often allowed to be introduced into the metal mold to hold the inserted parts.

Figure 11A:
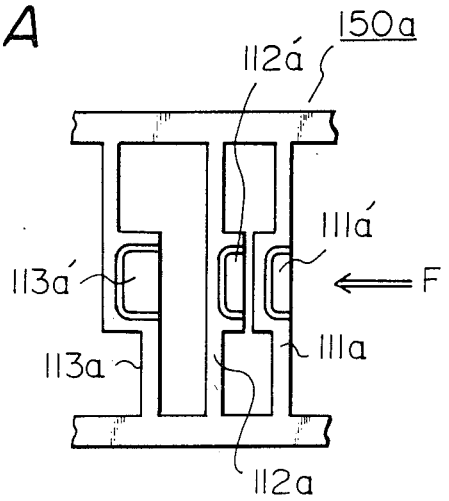
FIGS. 11A and 11B are a front view and a side view, respectively, illustrating an improved lead frame.
Figure 11B:
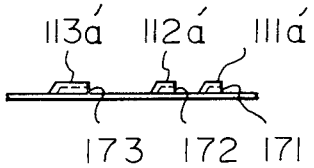

According to the present invention, as shown in FIGS. 11A and 11B, therefore, the contact lead terminals 111*a* through 113*a* of the lead frame 150*a* have projections 111*a'* through 113*a'* that protrude in a predetermined direction. The projections 111*a'* to 113*a'* each have three sides that are contiguous with the contact lead terminal member, and, further, have openings 171 through 173 through which the resinous material is allowed to flow in the direction of arrow F during the operation of insertion molding. Further, the contact lead terminals of the lead frame 150*b*, which are not shown, is provided with projections that protrude in the direction opposite to the projections 111*a'* through 113*a'*.

Figure 12:
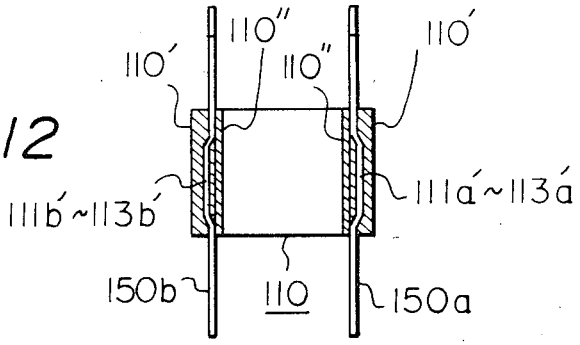
FIG. 12 is a sectional view showing an insertion-molded base in which the lead frame of FIG. 11 is inserted.

As shown in FIG. 12, therefore, if the lead frames 150*a*, 150*b* are disposed in a symmetrical manner in the metal mold, which is not shown, to mold the resin housing 110, which contains the central broadened portions of the contact lead terminals, the flow of the resin is divided toward the right and left directions of FIG. 12, owing to the openings 171 through 173, and then meets at the rear side (back side in the drawing) to fill the cavity in the metal mold. In this case, owing to projections 111*a'* through 113*a'* protruding toward the thick side 110' of the housing 110 and owing to the openings 171 through 173, the resinous material flows into the thick side 110' of the housing 110 and into the thin side 110'' in nearly equal amounts compared to the lead frames of the conventional construction (denoted by 150*a*, 150*b* in FIG. 6). Furthermore, the pressure of the resinous material, which has passed through the openings 171 through 173, is elevated in the thin portion 110''. On the other hand, the pressure of the resin which flows into the thick side 110' is reduced as it passes through the projections 111*a'* through 113*a'*. The contact lead terminals 111*a* through 113*a*, therefore, are maintained straight.

Figure 13A:
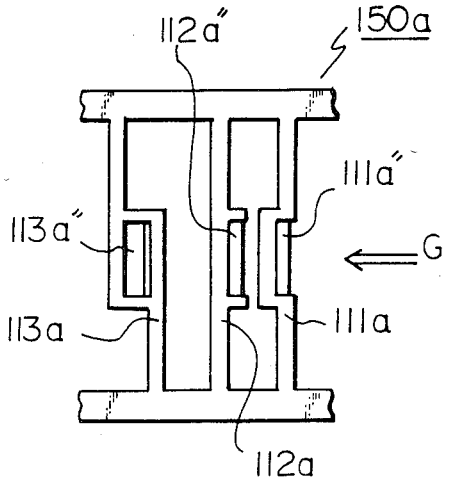
FIGS. 13A and 13B are a front view and a side view, respectively, showing another improved lead frame.
Figure 13B:
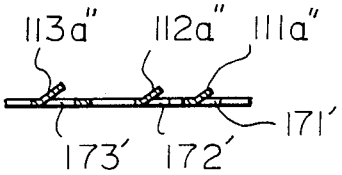

As shown in FIGS. 13A and 13B, furthermore, the central broadened portion of the lead terminal 113*a* may be provided with a projection 113*a''* that forms an O-shaped opening 173', and the central broadened portions of the lead terminals 111*a* and 112*a* may be provided with projections 111*a''* and 112*a''* that form C-shaped openings 171', 172'. The projections 111*a''* to 113*a''* rise in the same directions, and are tilted by about 45° toward the direction of arrow G in which the resinous material flows.

Figure 14:
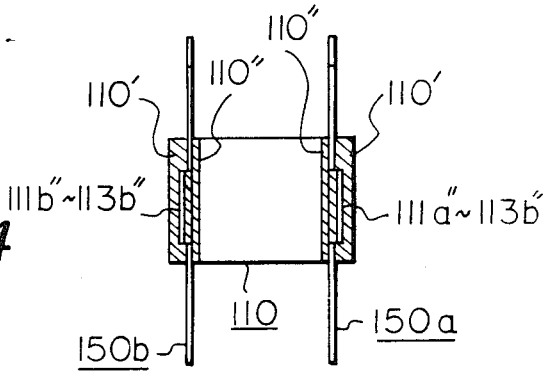
FIG. 14 is a sectional view of an insertion-molded base in which the lead frame of FIG. 13 is inserted.

As shown in FIG. 14, therefore, if the lead frames 150*a*, 150*b* are disposed opposite each other in the metal mold, which is not shown, and if the resin housing 110 is molded so as to contain the central broadened portions of the lead terminals 111*a* through 113*a* and 111*b* through 113*b*, part of the resin, allowed to flow into the thick side 110' of the housing 110, is guided by the projections 111*a''* through 113*a''*. The resin then flows through the openings 171' through 173' and flows into the thin side 110'' of the housing 110, so that the cavity in the metal mold is filled with the resin. In this case, the pressing force of the resin flow, acting upon the projections 111*a''* through 113*a''* protruding toward the thick side 110', works to equalize the pressure differential of the resin created by the difference of the gap between the thick portion 110' and the thin portion 110'', whereby the lead terminals 111*a* through 113*a* and the like are maintained straight.

Using lead frames constructed in this manner, therefore, it is possible to insertion-mold thin plate-like insertion parts having little mechanical strength without causing deformation thereof. Therefore, not only can the proportion of defective molded products can be reduced, but also molded products of a reduced thickness and a small size can be realized.

Figures 15A, 15B:
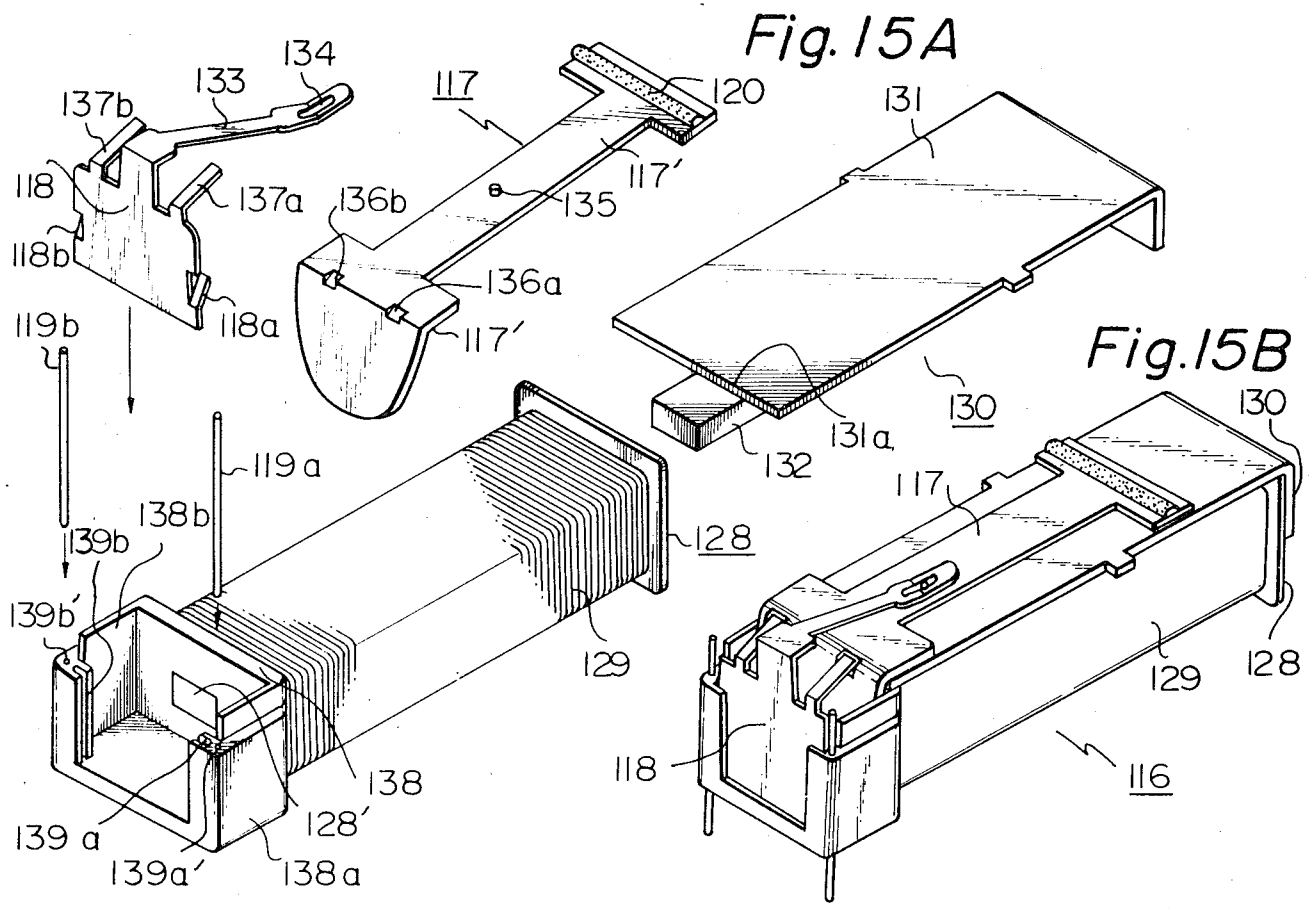
FIGS. 15A and 15B are perspective views illustrating the steps for assembling the electromagnet.

How the electromagnet 116 is assembled is described below with reference to FIGS. 15A and 15B. In FIG. 15A, an accommodation portion having protruding walls 138*a*, 138*b*, which extend perpendicularly, is formed on one flange 138 of the coil bobbin on which the coil 129 of the electromagnet 116 is wound, and grooves 139*a*, 139*b*, in which the armature-holding spring 118 is inserted, and insertion holes 139*a'*, 139*b'*, in which the coil terminals 119*a*, 119*b* are inserted, are formed in the walls 138*a*, 138*b* on the side remote from the flange surface. To assemble the electromagnet, first, the coil terminals 119*a*, 119*b* are inserted and secured in the insertion holes 139*a'*, 139*b'*, the coil 129 is wound on the coil bobbin 128, and lead wires of the coil 129 are connected by soldering to the upper ends of the coil terminals 119*a*, 119*b*. Then, the core portion 132 of the core 130 is firmly fitted into an insertion hole 128' of the coil bobbin 128, to fasten the coil bobbin 128 and the core 130 together. A corner 117' of the armature 117 is brought into contact with an end 131*a* of the yoke 131, and the armature-holding spring 118 is inserted into the grooves 139*a*, 139*b* of the coil bobbin 128. In this case, the opening 134 at the tip of spring piece 133 of the armature-holding spring 118 engages with the projection 135 of the armature 117, and tongue pieces 137*a*, 137*b* of the armature-holding spring 118 are engaged with recesses 136*a*, 136*b* of the armature 117. Thus, the armature 117 is pressed onto an end portion 131*a* of the yoke 131, being urged by tongue pieces 137*a*, 137*b* of the armature-holding spring 118, and is permitted to rotate with the end 131*a* serving in lieu of a shaft. Here, the spring piece 133 of the armature-holding spring 118 works to downwardly push the arm 117' of the armature 117, i.e., it works to restore the armature 117. Further, the raised pieces 118*a*, 118*b* of the armature-holding spring 118 work to prevent the armature-holding spring 118 from being removed from the grooves 139*a*, 139*b* of the flange 138. Thus, the electromagnet 116, which is shown in FIG. 15B, is manufactured.

Figure 16A:
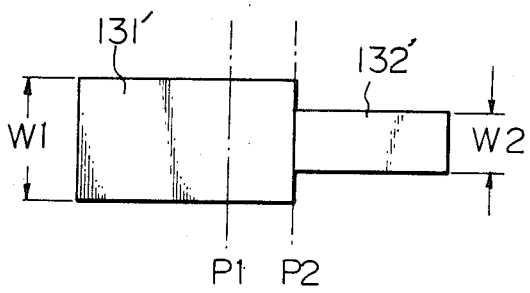
FIGS. 16A and 16B are a plan view and a side view, respectively, showing a magnetic member which is used for forming a core.
Figure 16B:
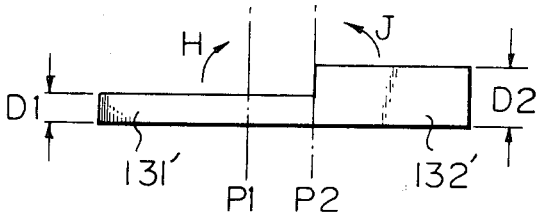

The core 130 employed for the electromagnet 116 is obtained by folding a magnetic member in a U-shape. As shown in FIGS. 16A and 16B, the magnetic member consists of a core portion 132' of a rectangular shape in cross section, which serves as the core 132, and a yoke portion 131' of a rectangular shape in cross section, which serves as the yoke 131. The core 132 and the yoke 131 have different widths and thicknesses. That is, the yoke portion 131' has a thickness D1, which is smaller than the thickness D2 of the core portion 132', making it possible to reduce the height of the relay and to obtain relays of more compact sizes. The yoke portion 131', however, has a width W1, which is greater than the width W2 of the core portion 132', so that both portions 131' and 132' have nearly the same sectional area. The above-mentioned magnetic member is folded at right angles at positions P1 and P2, indicated by chain lines in FIGS. 16A and 16B, in the directions indicated by arrows H and J, and a U-shape core is formed as shown in FIG. 17.

Figure 18A:
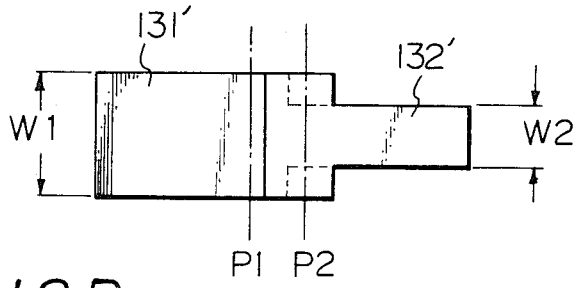
FIGS. 18A and 18B are a plan view and a side view, respectively, showing another magnetic member for forming a core.
Figure 18B:
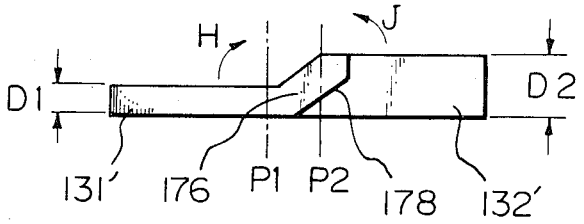
Figure 19:
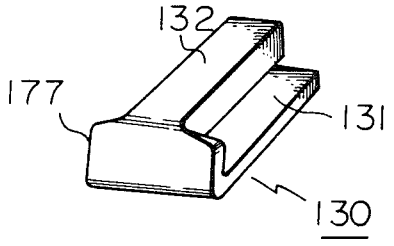
FIG. 19 is a perspective view of a core formed by using the magnetic member of FIG. 18.

When the magnetic member shown in FIGS. 16A and 16B is used, however, the thickness at the U-shaped bent portion 175 tends to be reduced, and the sectional area of the core at this portion is reduced, causing the reluctance at this portion 175 to be increased. The increase in the reluctance, however, can be prevented by employing, for example, a magnetic member that is shown in FIGS. 18A and 18B. The magnetic member shown in FIGS. 18A and 18B consists of the yoke portion 131' and the core portion 132'. Here, however, the portion of width W1 stretches into the core portion 132', passing over the folding position P2. Further, tilted portions 176 are so provided that the thickness will not change suddenly over the portion from the yoke portion 131' to the core portion 132'. Therefore, the sectional area of the core in the vicinity of the folding position P2 is greater than the sectional area of the yoke portion 131' or the core portion 132'. By folding the above-mentioned magnetic member at positions P1 and P2 in the directions of arrows H and J, the U-shaped core shown in FIG. 19 can be formed. In this case, since the thickness of the folding portion 177 around the folding position P2 is swollen, the sectional area of the core does not become smaller than that of the yoke portion 131 or the core portion 132, even in the portion where the thickness changes from D1 to D2. In FIG. 18B, cut portions 178 are provided to decrease the sectional area of the broad portion around the folding position P2, so that the width of the core 130 at the folding position P2 will not become greater than the width of the yoke portion 131. By using a magnetic member of the shape shown in FIGS. 18A and 18B, it is possible to maintain a uniform sectional area of the core of the magnetic circuit from the yoke portion 131 of core 130 to the core portion 132. Therefore, the reluctance is kept uniform, and the efficiency of the electromagnet is increased. Further, since a piece of the magnetic member is folded to obtain the core, no operation is required to fasten the core and the yoke together by caulking, which was required hitherto for assembling electromagnets.

What is claimed is:

1. In an electromagnetic relay in which an electromagnet assembly, having at least a core, a coil bobbin on which a coil is wound and an armature, is accommodated in a box-shaped insulated housing which has surrounding walls to hold fixed contact spring terminals and moving contact spring terminals, the improvement comprising:

said insulated housing has upper and lower surfaces which are open;

said coil bobbin has a flange;

said electromagnet assembly is incorporated into said insulated housing through the lower surface opening and includes accommodation means, having a portion that is molded on the outer surface of the flange of said coil bobbin as a unitary structure, for rotatably holding said armature, with said armature and said core being supported by said coil bobbin; and said electromagnetic relay further comprises a bottom plate that is fitted to the lower surface opening of said insulated housing and covers said electromagnet assembly.

2. An electromagnetic relay according to claim 1, wherein said core comprises a portion of a U-shaped unitary structure, the core portion being inserted into said coil bobbin, said U-shaped unitary structure further including a yoke portion that extends along the outer side of said coil bobbin, said yoke portion having a width wider than that of said core portion, said yoke portion being positioned in said insulated housing to close the upper opening thereof.

3. An electromagnetic relay according to claim 2, wherein said insulated housing includes protrusion means, extending from the upper portions of the opposing side walls of said housing at right angles with said side walls, for holding the electromagnet assembly.

4. An electromagnetic relay according to claim 2, wherein said yoke portion of said core has projections at both side portions thereof, and said insulated housing has, in the inner walls thereof, guide grooves that engage with said projections.

5. An electromagnetic relay according to claim 1, further comprising a relay cover, made of an insulating material, covering the upper opening of said insulated housing, said relay cover having a projection that can be removed from the outer side so that a ventilation hole is formed in the upper surface of the relay cover.

6. An electromagnetic relay, comprising:

a box-shaped insulated housing having upper and lower surfaces which are open and surrounding walls holding fixed and moving contact spring terminals;

an electromagnet assembly incorporated into said insulated housing through the lower surface opening, comprising:

a coil bobbin having a flange having an outer surface at one end and a coil wound thereon;

a U-shaped unitary structure, supported by said coil bobbin, comprising:

a core portion, inserted into said coil bobbin, having a first width; and a yoke portion, extending outside of said coil bobbin and positioned close to the upper surface opening in said insulated housing, having a second width wider than the first width;

an armature having a generally L-shape including a bent portion; and accommodation means for accommodating said armature, comprising:

a portion molded onto the outer surface of the flange of said coil bobbin as a unitary structure; and armature-holding spring means, affixed to the portion molded on the outer surface of the flange of said coil bobbin, for pressing the bent portion of said armature onto an edge of the yoke portion to rotatively support said armature.

7. An electromagnetic relay according to claim 6, further comprising elongated moving contact springs affixed to said moving contact spring terminals and extending over a portion of said armature, and an insulator attached to an end portion of said armature to insulate said moving contact springs from said armature.

8. An electromagnetic relay according to claim 6, wherein said armature has recessed portions on the outer side of its bent portion, and said armature-holding spring means includes tongue pieces that engage said recessed portions.

9. An electromagnetic relay according to claim 6, wherein said armature-holding spring means includes a spring piece to push said armature toward said yoke portion.

10. An electromagnetic relay according to claim 6, wherein said accommodation means includes a pair of coil terminals to which lead wires from said coil are connected.

11. An electromagnetic relay according to claim 1, wherein said fixed contact spring terminals and moving contact spring terminals are insertion-molded in the surrounding walls of said insulated housing.

12. An electromagnetic relay according to claim 11, wherein said fixed contact spring terminals and moving contact spring terminals are insertion-molded in the surrounding walls of said insulated housing at positions offset with respect to the center of said walls.

13. An electromagnetic relay, comprising:

a box-shaped insulated housing having surrounding walls holding fixed and moving contact spring terminals, said fixed contact spring terminals and said moving contact spring terminals being insertion-molded in the surrounding walls of said insulated housing and having projections embedded in the surrounding walls of said insulated housing, the projections protruding toward the side of the surrounding walls that is farthest from the fixed and moving contact spring terminals, the projections having openings to divert insulation material toward the side of the surrounding walls that is closest to the fixed and moving contact spring terminals, during the insertion molding; and an electromagnet assembly, enclosed by said box-shaped insulated housing, comprising:

a coil bobbin having a flange with an outer surface at one end and a coil wound thereon;

an armature;

accommodation means, having a portion molded on the outer surface of the flange of said coil bobbin as a unitary structure, for rotatably holding said armature; and a core supported by said coil bobbin.

14. An electromagnetic relay according to claim 12, wherein said fixed contact spring terminals and said moving contact spring terminals have folded pieces at portions that are embedded in the surrounding walls of said insulated housing, said folded pieces protruding toward the side of said walls that is farthest from said terminals, said folded pieces being folded in a direction that diverts part of the flow of the insulation material toward the side of said walls that is closest to said terminals during insertion molding.

15. An electromagnetic relay, comprising:

an elongated bobbin element having a first end, a second end, and a cavity region adjacent the second end;

a coil wound on said bobbin element between said first end and an intermediate position between said first and second ends;

a generally L-shaped armature disposed adjacent said coil, said armature having a first leg extending into said cavity region and a second elongated leg extending toward the first end of said bobbin element, said first and second legs intersecting at a bent portion of said armature;

means mounted on said bobbin element and extending into the bent portion of said armature for rotatably supporting said armature; and spring means, affixed to said bobbin element adjacent the second end thereof, for biassing said first leg of said armature toward said bobbin element.

16. The relay of claim 15, wherein said bobbin element has an elongated additional cavity extending from the first end of said bobbin element to the cavity region adjacent the second end, and wherein said means for rotatably supporting said armature comprises a generally U-shaped piece having a first elongated arm that is inserted into said additional cavity and a second elongated arm extending between the coil and the first leg of the armature, the second arm terminating in an edge that is substantially perpendicular to the axis of said bobbin element, said edge extending into the bent portion of said armature to rotatably support said armature.

17. The relay of claim 16, wherein the cross-sectional area of said U-shaped piece is substantially constant along the first arm, second arm, and portion joining the first and second arms.

18. The relay of claim 17, wherein said spring means comprises a spring element having an anchor portion lodged in grooves provided on said bobbin element adjacent the second end thereof and an elongated tongue portion pressing against the second leg of said armature.

19. The relay of claim 18, further comprising a housing having terminal elements molded in the walls thereof, and an elongated spring contact affixed to one of said terminals, said spring contact extending substantially parallel to said second leg of said armature.

* * * * *